US005921674A

United States Patent [19]

Koczi

[11] Patent Number: 5,921,674

[45] **Date of Patent: *Jul. 13, 1999**

[54] OPTICAL SIGNALLING DEVICE, ESPECIALLY FOR AN ITEM OF CLOTHING

[76] Inventor: Wolfgang Koczi, Am Olberg 62, Klosterneuburg, Austria, A-3400

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,232

[22] PCT Filed: Jul. 10, 1996

[86] PCT No.: PCT/AT96/00119

§ 371 Date: Mar. 19, 1997

§ 102(e) Date: Mar. 19, 1997

[87] PCT Pub. No.: WO97/04434

PCT Pub. Date: Feb. 6, 1997

[30] Foreign Application Priority Data

| | | | |
|---|---|---|---|
| Jul. 19, 1995 | [AT] | Austria | 1231/95 |
| Jul. 26, 1995 | [AT] | Austria | 1277/95 |
| Nov. 9, 1995 | [AT] | Austria | 1848/95 |

[51] Int. Cl.[6] ..... F21L 11/00

[52] U.S. Cl. ..... 362/800; 362/103; 362/106

[58] Field of Search ..... 362/103, 105, 362/106, 800

[56] References Cited

U.S. PATENT DOCUMENTS

| | | | |
|---|---|---|---|
| 4,231,079 | 10/1980 | Heminover | 362/800 |
| 4,319,308 | 3/1982 | Ippoliti et al. | 362/106 |
| 4,559,586 | 12/1985 | Slarve | 362/106 |
| 4,570,206 | 2/1986 | Deutsch | 362/106 |
| 4,760,373 | 7/1988 | Reilly | 362/106 |
| 4,769,629 | 9/1988 | Tigwell | 362/106 |
| 4,875,144 | 10/1989 | Wainwright | 362/103 |
| 4,945,458 | 7/1990 | Batts et al. | 362/106 |
| 5,040,099 | 8/1991 | Harris | 362/106 |
| 5,111,366 | 5/1992 | Rife et al. | 362/31 |
| 5,184,253 | 2/1993 | Hwang | 359/889 |
| 5,207,500 | 5/1993 | Rios et al. | 362/106 |
| 5,329,637 | 7/1994 | Walker | 362/106 |
| 5,357,361 | 10/1994 | Nishizawa | 359/142 |
| 5,357,409 | 10/1994 | Glatt | 362/800 |
| 5,404,593 | 4/1995 | Kronenberger | 362/106 |
| 5,416,675 | 5/1995 | DeBeaux | 362/106 |
| 5,485,358 | 1/1996 | Chien | 362/106 |
| 5,510,961 | 4/1996 | Peng | 362/800 |
| 5,544,027 | 8/1996 | Orsano | 362/800 |
| 5,559,680 | 9/1996 | Tabanera | 362/106 |
| 5,570,946 | 11/1996 | Chien | 362/106 |
| 5,680,718 | 10/1997 | Ratcliffe et al. | 362/106 |
| 5,704,707 | 1/1998 | Gebelein et al. | 362/106 |
| 5,722,192 | 3/1998 | Salley | 362/106 |

FOREIGN PATENT DOCUMENTS

| | | |
|---|---|---|
| 39 00 417 | 8/1989 | Germany . |
| 44 08 951 | 9/1994 | Germany . |

*Primary Examiner*—Laura Tso
*Attorney, Agent, or Firm*—Jacobson, Price, Holman & Stern, PLLC

[57] ABSTRACT

The invention relates to an optical signalling device, more particularly for an article of clothing, consisting of at least two actively illuminating light sources 5, which are preferably designed to emit light of different colors and are connected to a control circuit 3 for activating the light sources 5 in a predetermined rhythm, the control circuit 3 being connected to a switch, key 2 or the like for its manual activation and/or deactivation. To obtain an optical signalling device which can be activated not only manually, but also externally, the light sources 5 can be activated manually (switch position I) or by remote control (switch position II). Via the remote control system the light sources 5 can be activated via a receiver 4. As a result, many identical optical signalling devices can be activated simultaneously by a coordinator or automatically at, for example, mass (heavily attended) events, so that an enhanced optical effect is achieved. According to one feature of the invention, the colors of the light sources 5 can correspond to those of certain clubs, organizations or nationalities.

8 Claims, 4 Drawing Sheets

OPTICAL SIGNALLING DEVICE, ESPECIALLY FOR AN ITEM OF CLOTHING

Figure 1:
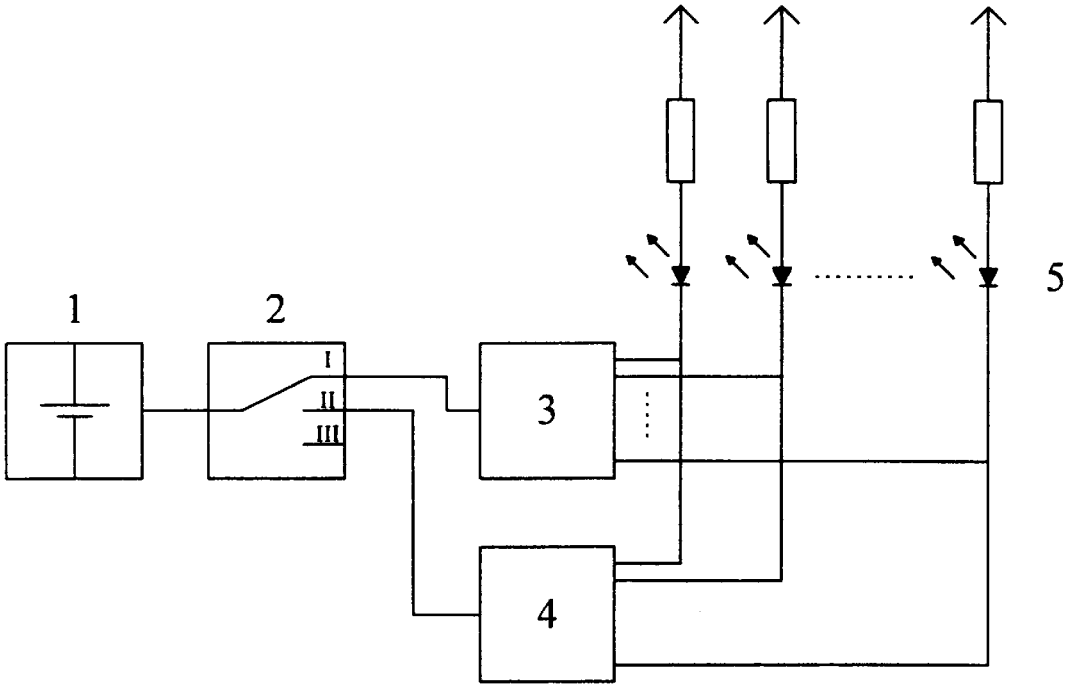

The invention relates to an optical signalling device, more particularly for an article of clothing, as set forth in the preamble of claim 1.

Articles of clothing are known which for the safety of the wearer are provided with optical signalling devices, for example, reflectors, or with reflecting strips, small plates or the like illuminated from a light source. Helmets have also existed which are equipped with lamps or search lights, to enable the wearer to work with both hands with the greatest possible freedom of movement in dark surroundings.

Various articles of clothing are also known which have optical signalling devices for producing optical effects intended for entertainment or publicity purposes. DE-OS 39 00 417 discloses a graphic display device consisting of a plurality of discrete light sources forming part of a picture which is printed onto an article of clothing. The illustration can be animated by the activation of a control circuit operating the light sources. U.S. Pat. No. 4 875 144 discloses a similar invention, wherein a plurality of glass fibers is worked into an article of clothing, the ends of the fibers extending through the fabric of the article of clothing and being arranged in accordance with different pictures (images). In all these devices the sequence of illumination of the light sources is manually activated via a control circuit.

It is an object of the invention to provide an optical signalling device, more particularly for an article of clothing, which produces purely aesthetic or entertaining optical effect and is not only manually controlled, but can also be activated externally via, for example, a coordinator or particular delivered signals.

The problem to which the invention relates is solved by the features of the characterizing part of claim 1. The light sources can be activated both manually and by remote control. For example, the wearer of the optical signalling device can activate the control circuit manually, whereafter the light sources connected to the control circuit are activated in a predetermined rhythm. For example, a fan of a football club can in this way express his pleasure that a goal has been scored. The possibility of actuation by remote control enables the light sources of the optical signalling device to be activated when certain events occur. For example, at a sporting event, a goal is scored, for example, a coordinator can activate the optical signalling device, or said device is activated automatically if the line is passed over.

According to another feature of the invention a large number of identical optical signalling devices can be activated simultaneously and in synchronism via a remote control. The result is an enhanced optical effect. Synchronous activation is performed by cableless transmission of the information required for the controlled activation of the light sources. For example, at a football stadium when a goal has been scored a coordinator can activate all the signalling devices of a fan club simultaneously via remote control.

According to the features of claim 3 the remote control activation of the light sources can be effected via high frequency, infra red light or acoustic signals. The kind of remote control can be selected in accordance with various aspects, such as the presence of certain transmitting installations, guidelines, transmission characteristics, etc. For example, at stadiums, usually loud speaker installations are present, via which the remote control activation of the optical signalling devices can be effected without the installation of special transmitting installations.

According to another feature of the invention the colors of the light sources correspond to those of certain clubs, organizations or nationalities. In this way the members of such clubs, organizations or nationalities can show themselves as such and demonstrate their affiliation.

The light sources can also be differently colored by covering with different colors. This economically enables even colors to be obtained which are not, for example, in the color spectrum of available light sources such as, for example, light-emitting diodes.

With the light sources arranged in the form of a matrix, a sufficient number of light sources, symbols or graphics can be displayed in a similar manner as in advertising panels.

Preferably, the optical signalling device according to the invention takes the form of a head covering, for example, in the form of a baseball cap. Such a cap, which is at present particularly favoured by sporting amateurs and young people is thereby adapted in a practical manner which appeals to the wearers, while at the same time the peak of the cap is able to prevent the light effect from dazzling or similarly bothering the wearer. Moreover, light sources disposed on headwear can not so easily be concealed, for example, by the spectator in front in the stadium. Since the optical signalling device should advantageously be disposed in the viewing direction of the wearer, headgear is advantageous, since it accompanies the movements of the wearer's head.

Of course, various other applications, variations and constructional alterations can be made within the framework of the invention. For example, at sporting events the caps or clothing of the spectators and/or sportsmen or sportswomen can be provided with light elements which can be illuminated and switched off, for example, by remote control. Each wearer can switch his or her own light element on and off, or else a coordinator or one of the participants can at choice switch on and off the light elements of all the wearers by remote control, for example, via a transmitter. At sporting events where two or more groups of club fans are present, each group can wear the light elements of its own club, and only the elements of one group or another can be switched on and off by the coordinator concerned.

Figure 2:
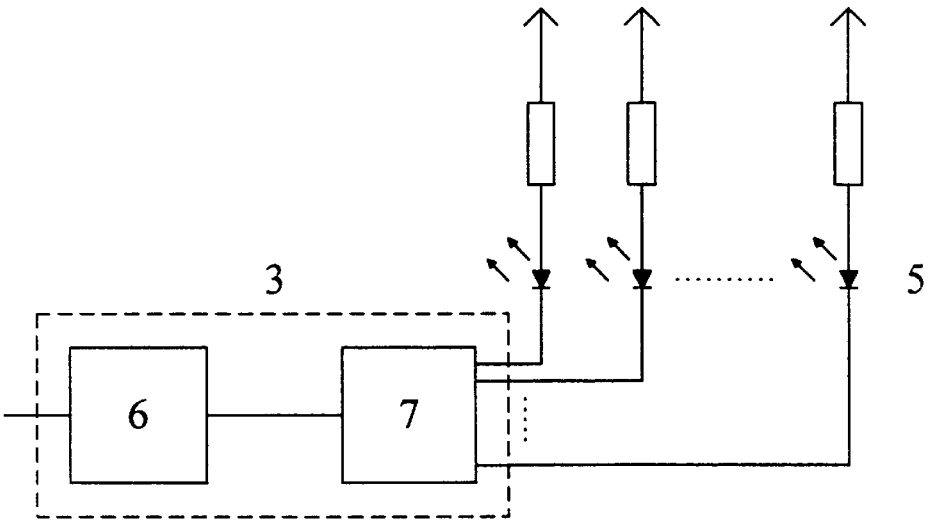
Figure 3:
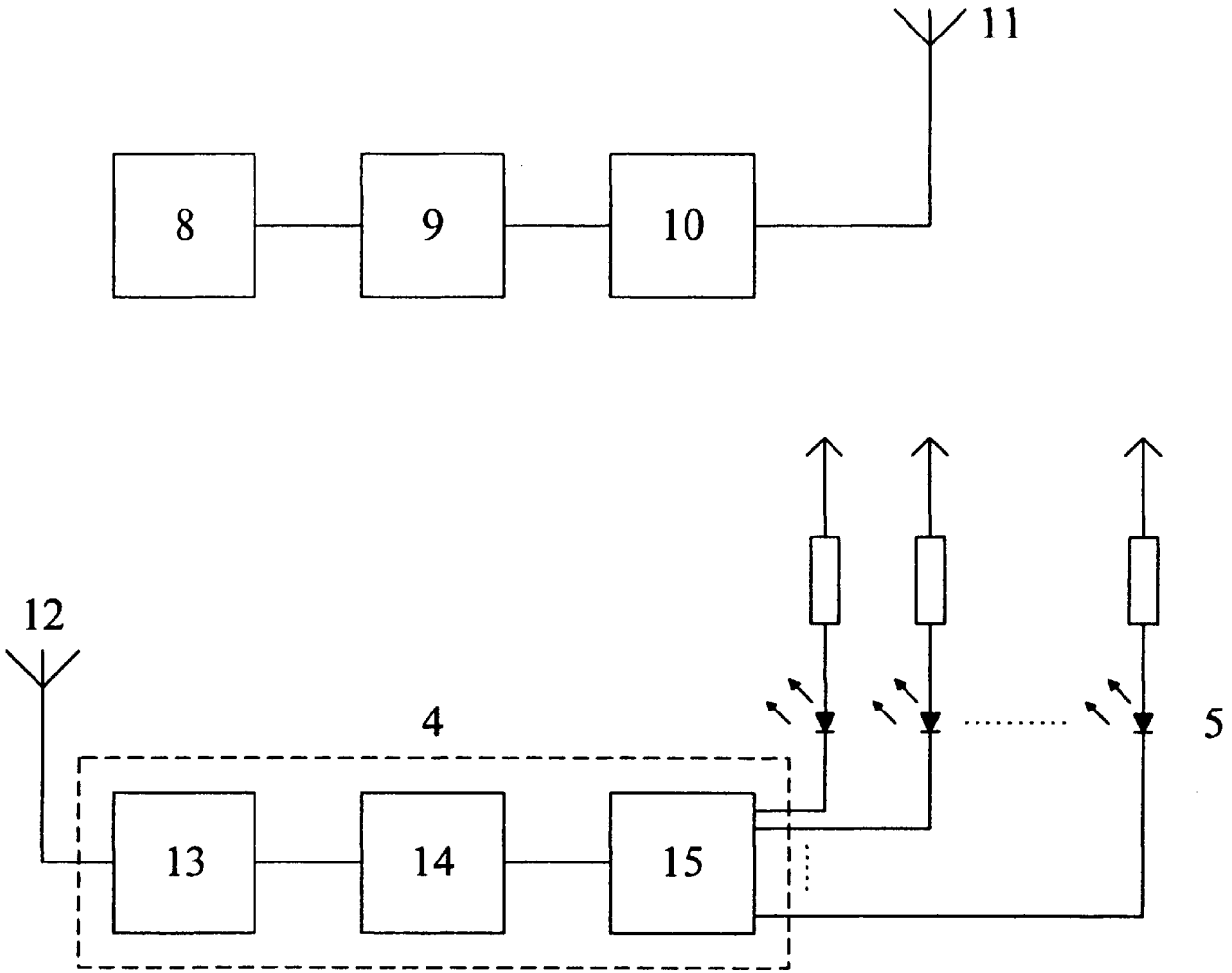
Figure 4:
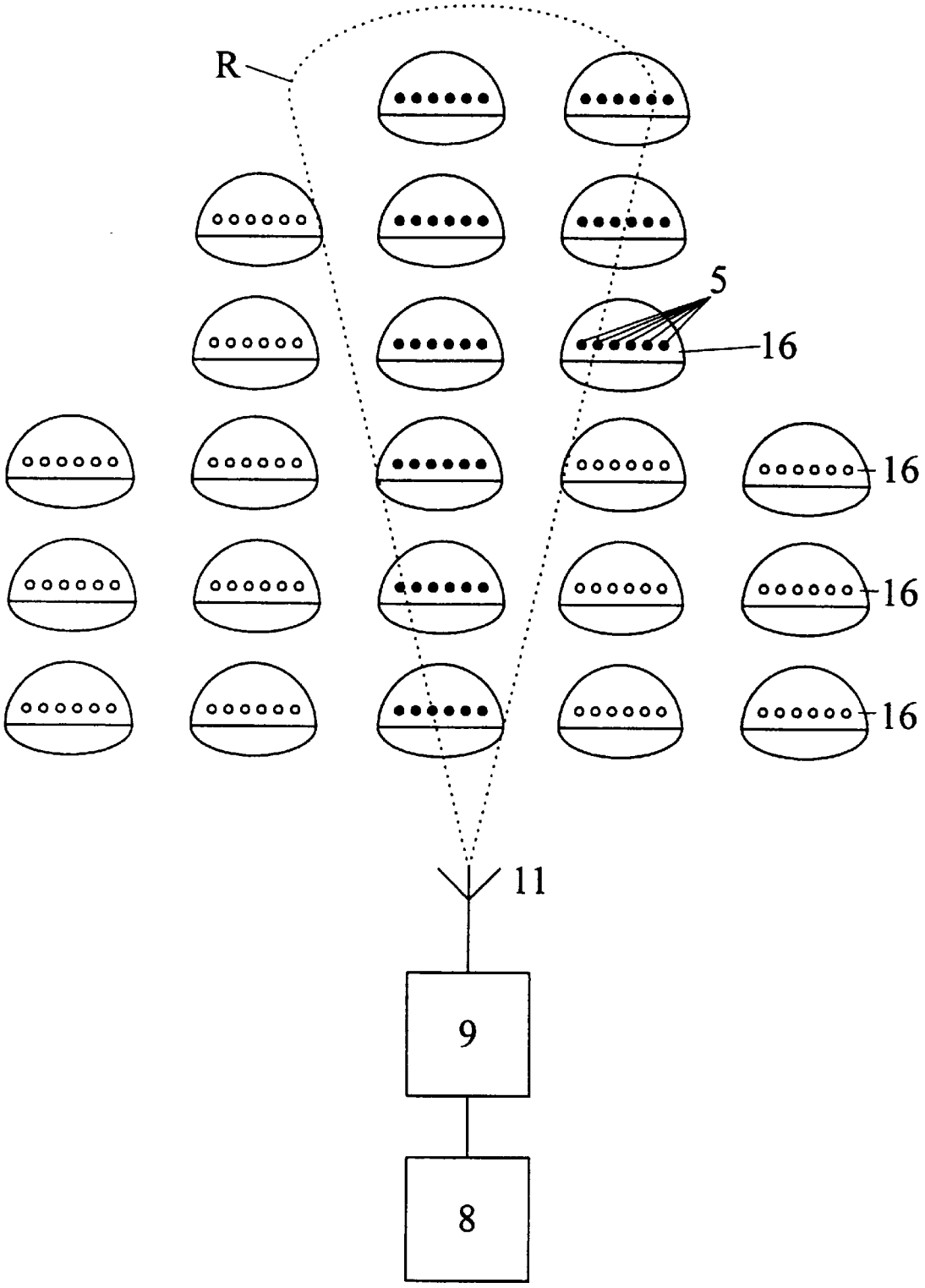
Figure 5C:
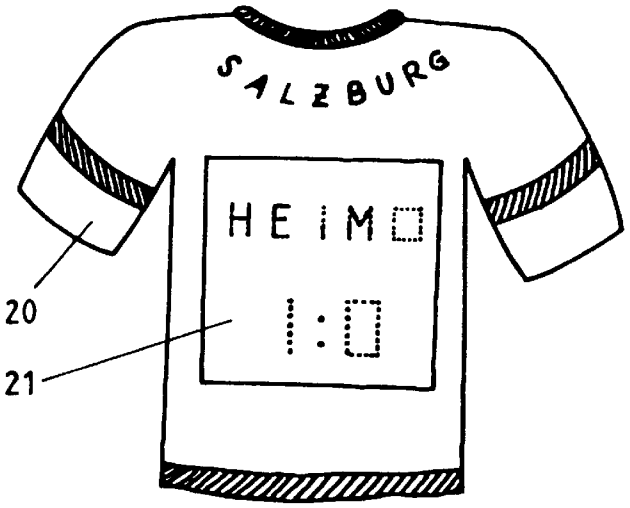
Figure 5B:
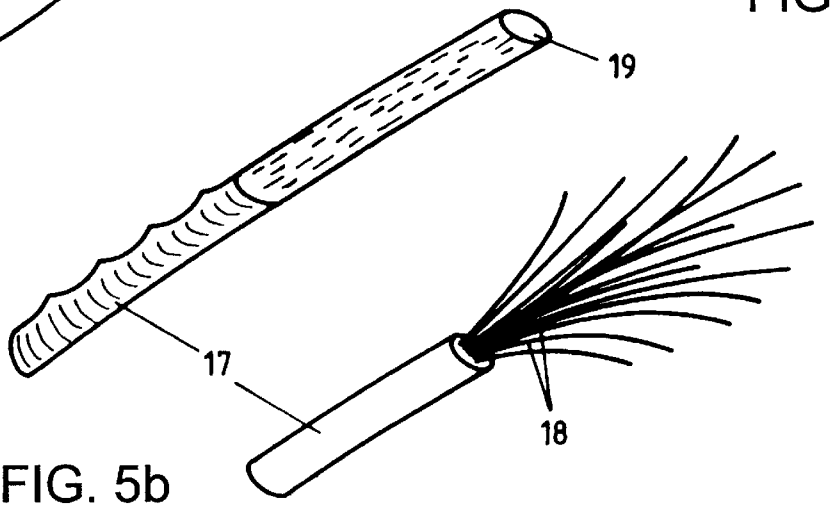
Figure 5A:
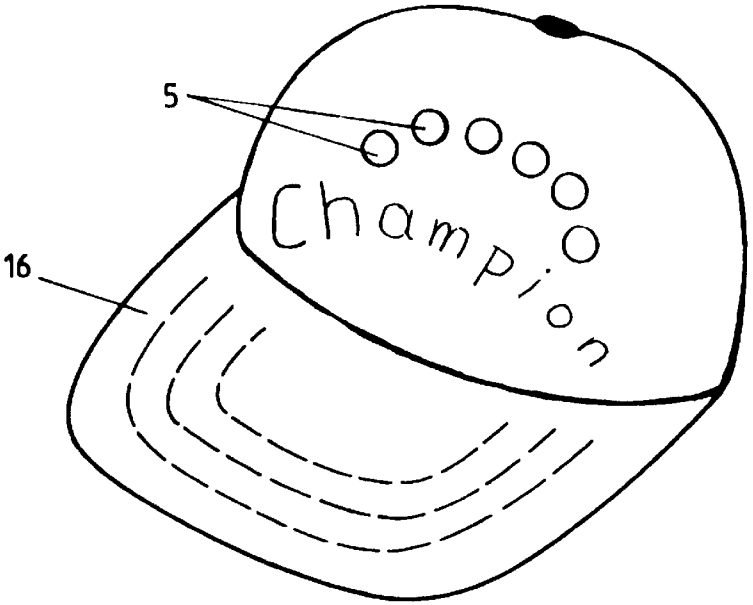

Similar signalling devices can also be used for advertising purposes in publicity spots, advertising signs, company signs, etc. Other features of the invention will now be explained with reference to the accompanying drawings, which show:

FIG. 1 a block circuit diagram of one embodiment of the optical signalling device, FIG. 2 a detailed block circuit diagram of the control system shown in FIG. 1, FIG. 3 a detailed block circuit diagram of one embodiment of an external control system (remote control) and of the receiver of the optical signalling device, FIG. 4 a circuit diagram of the remote control activation of a plurality of optical signalling devices, and FIGS. 5*a* to 5*c* different embodiments of the optical signalling device.

Referring to FIG. 1, an optical signalling device comprises a voltage source 1, a changeover switch 2, a control system 3, a receiver 4 and light sources 5. The voltage source 1 is advantageously formed by low voltage accumulators or batteries. In many applications, voltage supply or boosting by solar cells can be considered. In the embodiment illustrated the switch 2 has three contacts available for the selection of the three functions; I internal control (manual control), II external control (remote control), III "off" (inoperative). In switch position I the internal control system 3 is activated and operates the light sources 5 in a preprogrammed rhythm. In switch position II the receiver 4 is activated, thereby making possible the reception of external control signals (remote control). In switch position III the connection to the voltage supply is interrupted, so that no operation is possible. Instead of using a switch, the operational mode can also be switched over by means of a key, the operational mode being changed with each depression of the key. In the drawings the light sources 5 are shown to be light-emitting diodes. The use of LEDs makes possible the colors yellow, orange, red, green and blue. To obtain other colors, correspondingly colored transparent plastics parts are placed in front of the light source. Care must be taken in that the light sources have adequate illuminating intensity for an adequate optical effect. The optical signalling device is characterized by small height and low voltage consumption and manufacturing costs.

FIG. 2 shows an embodiment of the control system 3 shown in FIG. 1. The control system 3 comprises an oscillator 6 generating a timing signal of suitable frequency which times a logic circuit 7. In dependence on the required order of illumination of the light sources, the operating logic circuit 7 can consist of a simple counter or an individually programmed digital integrated circuit (IC). With a counter the LEDs 5 can be illuminated in sequence, while any required switching sequences can be programmed using more complex customized IC or microcontrollers.

FIG. 3 shows the transmitting device required with the external (remote) control of the optical signalling device transmitting the control pulses, and also one embodiment of the receiver of the optical signalling device shown in FIG. 1. The transmitter side circuit consists of a triggering circuit 8, an encoder 9 and a transmitter 10 with transmitting antenna 11. In the simplest case the triggering circuit 8 consists of a key which can be actuated, for example, by a coordinator when a certain event takes place. However, the triggering pulse can also originate from a light barrier or a sensor, which delivers a signal when a predetermined threshold is exceeded. Following said triggering, an encoding or an encoding sequence is activated encoder 9. The encoding contains the information required for controlling the light sources 5 in the reception side circuit. The transmitter 10 is modulated with the generated codes, and the signal is radiated by the antenna 11. Transmission is via a high frequency signal carrier in the corresponding frequency band. The transmitting energy is adjusted in accordance with the required range and the regulations in force. A receiving antenna 12 receives the remote control signals, which it feeds to a receiver 13. A decoder 14 obtains the information from the signal received and is fed to an operating circuit 15 which operates the light sources 5. The remote control activation enables certain light sources of a plurality of identical optical signal devices to be operated synchronously, the result being an increased optical effect. If the remote control is via a infra red light, use is made of an infra red light-emitting diode or an infra red laser, an infra red photodiode, for example, being used instead of the receiving antenna 12; in the case of remote control via acoustic signals, a loud speaker acts as the transmitter and the microfilm as the receiver. Acoustic remote control may be advantageous in cases where acoustic installations already exist. In the case of a stadium, for example, loud speaker installations are usually present which can be used to transmit the control signals for the optical signalling device. The signals can lie outside the range of hearing of the human ear (e.g. ultrasonics) or in the audible frequency range. Since microphones are very cheap, the optical signalling devices can be very reasonable in price and therefore accessible by the broad masses. Another advantage of acoustic control lies in the propagation properties of sound waves, which are favorable for this application. The microphones on the optical signalling devices must not be aligned with the transmitting device (loud speaker). Moreover, the optical signalling devices can be activated by certain sequences of notes such as, for example, a particular melody characterizing a sports club. At musical events it is also conceivable for the illuminating elements to be automatically activated in time with the music.

FIG. 4 is a basic circuit diagram for the remote control activation of a plurality of optical signalling devices. A large number of spectators at, for example, a stadium have the signalling devices according to the invention in the form, for example, of baseball caps 16 with light sources 5. If a goal is scored during a football match, a coordinator can activate a triggering circuit 8, for example, by pressing a button, thereby switching on a transmitter 10. If the remote control is via infra red light, the control signals are radiated via transmitting antenna H, realized by an infra red light source whose transmitting image and rectification characteristic R is selected in accordance with requirements. If the optical signalling devices 16 of all the fans are to be activated simultaneously, a wide rectification characteristic R as possible is selected. If controlled activity is to take place, a narrow rectification characteristic R of the transmitting diode 11 will be necessary. With a suitably narrow transmitting beam, theoretically different patterns or even atoms of information can be "written" into the spectators area. The signalling devices according to the invention would therefore be suitable also for switching on informational items or advertising. In the case of supraregional events, remote control by means of high frequency signals via satellite might also be conceivable.

FIGS. 5*a* to 5*c* show a number of embodiments of the optical signalling device according to the invention. 5*a* shows an article of clothing in the form of a baseball cap 16 with integrated light-emitting diodes 5. The entire electronic system, the voltage supply and the receiving device required for the reception of the remote control signals (receiving antenna with high frequency transmission or photodiode with optical transmission) are integrated in the baseball cap. In dependence on the remote control method used, the cap contains a receiving antenna, a photodiode or a microphone. The light-emitting diodes 5 are activated by the control signals received. The embodiments shown in FIG. 5*b* are illuminating rods consisting of the light sources and a handle 17 which contains the electronic system, the voltage supply and the reception circuit. In the right-hand illustration use is made of optical fibers 18, which are coupled to the active illuminating elements in the handle and transmit the light to the end of the fibers. In the left-hand embodiment the light sources are integrated in a plastics member 19. The illuminating rods are activated and particular sequences of illumination are passed via a remote control pulse. In FIG. 5*c* the optical signalling device is placed on or integrated in a sweatshirt 20. The active light sources are arranged in the form of a matrix 21. In dependence on the number, arrangement and colour of the light sources of the matrix 21 it is possible to display letters, text or graphics such as, for example, the goal keeper and the state of play at a football match. The necessary information for the correct operation of individual illuminating elements is transmitted together with the remote control signal. The necessary electronic system, voltage supply and reception device is also integrated in the sweatshirt.

Embodiments of the invention are not limited to the examples illustrated. The device according to the invention can also have a velcro closure and be placed on any article of clothing.

The possible uses of the signalling device according to the invention are versatile and not limited to the exemplary embodiments described. However, heavilyattended (mass) events, such as sporting events or concerts are to be preferred. For greater optical effect, use is preferably in dark rooms for an evening darkness. For example, if a goal is scored at a football match, the colors of the scoring club light up simultaneously and cyclically on all the fans equipped with such an optical signalling device, thus encouraging the team in question. Without the use of wires, for example, the state of play at a football match can also be transmitted to and displayed on the clothing of the spectators. Existing public illuminating matrixes can also be used for displaying small advertising texts or company logos. At concerts also this device can be used to express the audience's enthusiasm.

I claim:

1. A combination comprising a plurality of identical optical signaling devices for producing purely aesthetic or entertaining optical effects each having a plurality of light sources, control circuit means connected to each of said optical signaling devices for activating said light sources, manual activating and deactivating means for manually activating and deactivating said control circuit means, and remote control system means adapted to send a control signal to said optical signaling devices for simultaneously activating and deactivating in synchronism a plurality of said optical signaling devices for producing said optical effects.

2. The combination of claim 1, wherein said signals are high frequency, infrared light or acoustic signals.

3. The combination of claim 1, wherein said light sources of each of said optical signaling devices emit light of predetermined color combinations.

4. The combination of claim 1, wherein said light sources are covered with different colors.

5. The optical signaling devices of claim 1, wherein said light sources are simultaneously activated in synchronism in a matrix to optically form symbols or graphics.

6. The combination of claim 1, wherein said optical signaling devices are baseball caps.

7. The combination of claim 1, wherein said optical signaling devices are items of clothing.

8. A combination comprising a plurality of identical optical signaling devices for producing purely aesthetic or entertaining optical effects each having a plurality of light sources which emit light of predetermined color combinations, control circuit means connected to each of said optical signaling devices for activating said light sources, manual activating and deactivating means for manually activating and deactivating said control circuit means, and remote control system means adapted to sand a high frequency, infrared light or acoustic control signal to said light sources for simultaneously activating and deactivating in synchronism a plurality of said optical signaling devices in a matrix to optically form symbols or graphics.

* * * * *